US008221175B2

(12) United States Patent
Mynster

(10) Patent No.: US 8,221,175 B2
(45) Date of Patent: Jul. 17, 2012

(54) TROLLING MOTOR STEERING SYSTEM

(75) Inventor: Richard J. Mynster, Louisburg, KS (US)

(73) Assignee: RM Industries, Inc., Kansas City, KS (US)

( * ) Notice: Subject to any disclaimer, the term of this patent is extended or adjusted under 35 U.S.C. 154(b) by 175 days.

(21) Appl. No.: 12/765,537

(22) Filed: Apr. 22, 2010

(65) Prior Publication Data

US 2010/0273367 A1 Oct. 28, 2010

Related U.S. Application Data

(60) Provisional application No. 61/172,122, filed on Apr. 23, 2009.

(51) Int. Cl.
*B63H 5/125* (2006.01)

(52) U.S. Cl. ..... 440/62; 114/144 R

(58) Field of Classification Search ..... 114/144 R; 248/548, 640, 641, 642, 643; 440/6, 7, 53, 440/62

See application file for complete search history.

(56) References Cited

U.S. PATENT DOCUMENTS 3,602,181 A * 8/1971 Harris ..... 440/7
4,149,691 A * 4/1979 Moeser ..... 248/642
4,432,527 A * 2/1984 Sample ..... 248/640
4,927,816 A 5/1990 Ester
5,171,174 A * 12/1992 Mynster ..... 440/7
5,389,017 A * 2/1995 Huzjak ..... 440/53
5,465,633 A 11/1995 Bernloehr
5,507,242 A * 4/1996 LeBlanc et al. ..... 440/6
5,725,401 A 3/1998 Smith
6,468,117 B1 10/2002 Healey
6,620,005 B1 * 9/2003 Butz ..... 440/62
6,669,516 B1 * 12/2003 Husted et al. ..... 440/6
7,056,166 B2 * 6/2006 Bernloehr ..... 440/6
7,473,148 B2 1/2009 Ichikawa et al.
7,481,688 B2 1/2009 Kobayashi
7,497,746 B2 3/2009 Okuyama
7,497,748 B2 3/2009 Salmon

* cited by examiner

*Primary Examiner* — Lars A Olson
(74) *Attorney, Agent, or Firm* — Lathrop & Gage LLP

(57) ABSTRACT

A steering mount for use with a watercraft trolling motor. The steering mount including a bracket assembly for securing the steering mount to a substantially vertical surface of a watercraft. The mount also includes an arm member pivotally secured to the bracket assembly and a drive assembly secured to the arm member. A transom block is also attached to the drive assembly to which the trolling motor can be releasably secured. A first and second drive cable are utilized for rotating the transom block and a foot pedal is attached to the first and second drive cable for selectively imparting tension upon either the first or second cable to thereby rotate the transom block. A first and second electrical switch are disposed within the foot pedal for providing power to the trolling motor and for activating the trolling motor when needed.

28 Claims, 14 Drawing Sheets

TROLLING MOTOR STEERING SYSTEM

RELATED APPLICATION

This application claims the benefit of the filing date of a U.S. Provisional Patent Application Ser. No. 61/172,122 which was filed on Apr. 23, 2009, the disclosure of which is incorporated herein by reference.

BACKGROUND AND SUMMARY OF THE INVENTION

1. Field of the Invention

The present invention relates generally to the control of propeller-driven electric motors, and in particular to transom-mounted and gunwale-mounted trolling motors.

2. Description of the Related Art

Trolling motors are popular as the primary or secondary watercraft propulsion system. Trolling motors mounted to the transom or gunwale of a watercraft are used for low speed maneuvering. Electric trolling motors consist of a vertical support shaft attached to a submerged electrically-powered motor driving a propeller, controlled by a tiller located above the water. The support shaft is mounted to the transom or gunwale of the watercraft, thereby providing a fixed structure for manually rotating the tiller, and changing the direction of thrust generated by the motor.

Electric trolling motors are used by fishermen to slowly maneuver a boat into an area targeted for fishing without startling the fish. However, adjusting the direction of thrust of the motor requires the fisherman to control both the trolling motor and the fishing rod, or suspend fishing while maneuvering the boat. The foot pedal controls the power to the trolling motor and controls rotation of the support shaft, and in turn, the direction of thrust generated by the electric motor. The use of a foot pedal to control the operation of a trolling motor enables the fisherman to concentrate on using both hands to control the fishing rod, and use the foot pedal to maneuver the boat. However, foot control pedals are not readily compatible with all existing trolling motors.

There is a need for a hands-free system and apparatus for controlling trolling motors that can be used with legacy and current models of trolling motors. Heretofore there has not been available a hands-free system and apparatus for controlling trolling motors with the advantages and features of the present invention.

BRIEF SUMMARY OF THE INVENTION

An embodiment of the invention relates to a steering system and mount for a hand-controlled transom-mounted electric trolling motor. The mount is installed outboard on the transom of a boat and provides for attachment of a trolling motor thereon. The mount permits hands-free control of the trolling motor using an inboard foot pedal connected to the mount by control cables.

The mount consists of a horizontal transom block rotating upon a drive assembly connected to a bracket assembly by arms. The transom block is connected to a vertical shaft that is received within a drive assembly and rotates about a vertical axis. The drive assembly consists of a pair of sealed ball bearings that securely receive the shaft, mounted within the internal races of the bearings. A drive collar is securely attached to the shaft by a spring pin midway between the bearings. The drive collar consists of a pair of separator flanges and retaining posts to separate the upper and lower cables and to restrain the cables from becoming jammed between the drive collar and the housing and retaining pockets for securing the ends of the cables. Ball fittings on the upper and lower control cables slide within upper and lower retaining pockets on the drive collar permitting the cables to each partially wrap around the shaft. The arm members are pivotally connected to the bracket assembly permitting rotation of the arm members and drive assembly away from the water. The bracket assembly is mounted on the transom of a boat and releasably secured using screw-type clamps. A trolling motor is secured to the transom block by tightening the screw-type clamps on the motor mount. Rotation of the trolling motor within its mount is prevented by securing a tension screw.

Steering of a trolling motor attached to the mount is accomplished by a foot pedal. The foot pedal operably communicates with the drive collar assembly by pulling control cables inboard from the drive collar assembly when rotating the foot pedal along a pivot shaft thereby rotating the transom block and the attached trolling motor about the rotational axis.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENT

I. Introduction and Environment

Figure 1:
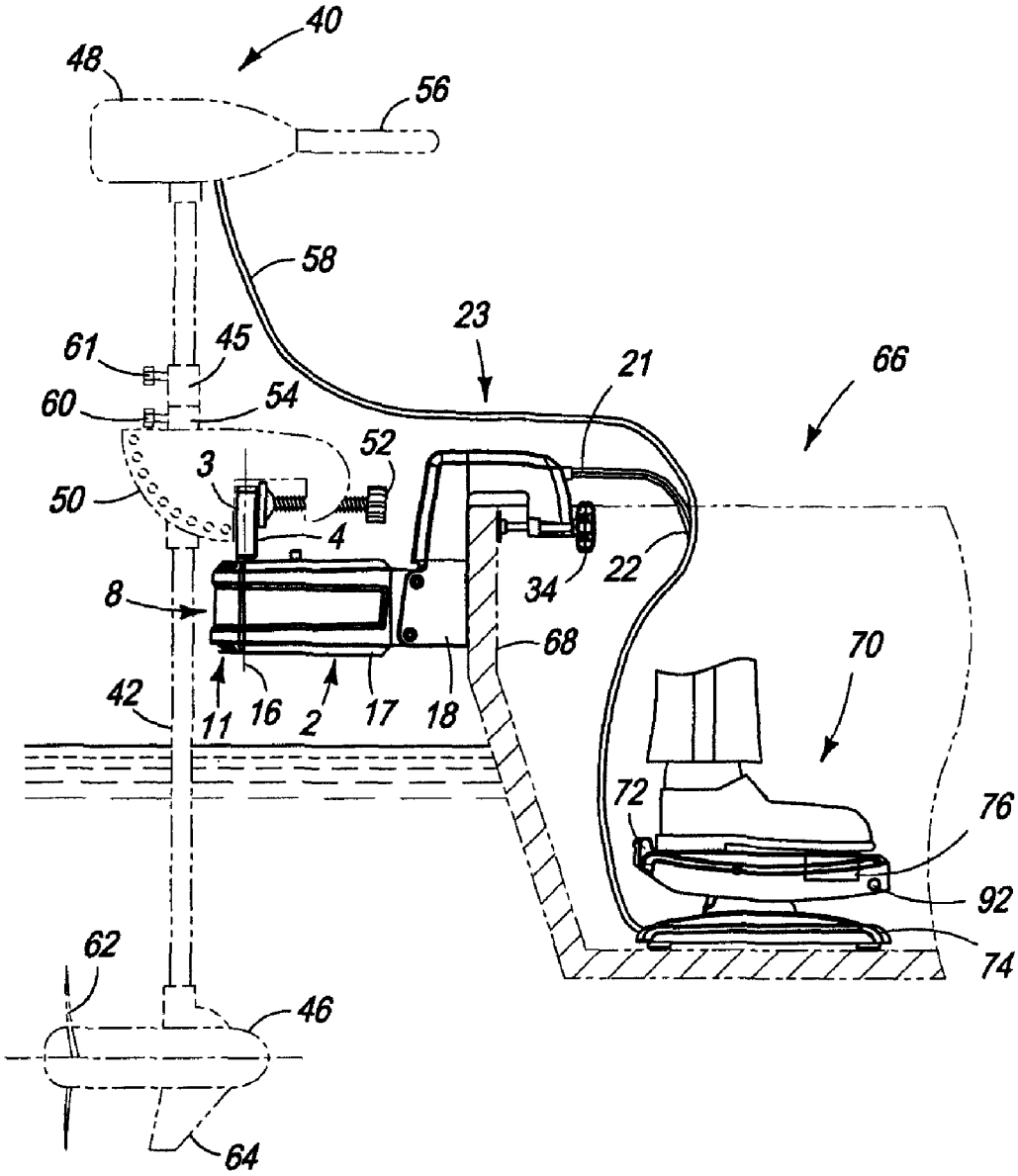
FIG. 1 is an elevation view of a preferred embodiment of a steering mount having a trolling motor mounted thereto, attached to the transom of a boat.

As required, detailed aspects of the present invention are disclosed herein; however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof Inboard refers to the direction toward the inside of the boat. Outboard refers to the direction outside of the boat. Forwardly and rearwardly are generally in reference to the direction of travel, if appropriate. Said terminology will include the words specifically mentioned, derivatives thereof and words of similar meaning.

II. Preferred Embodiment Motor Mount 2.

Referring to the drawings in more detail, the reference numeral 2 generally designates a trolling motor mount embodying the principles of the present invention. The mount 2 permits hands-free control of a trolling motor 40 using a foot pedal 70. Each of the foregoing will be described in turn.

Referring to FIG. 1, a boat 66 located in a body of water is depicted having a conventional hand-controlled trolling motor 40 attached to a mount 2, wherein the mount 2 is attached to the transom 68 of the boat 66. A foot pedal 70 located in the boat 66 is operably connected to the mount 2 by control cables 21, 22, permitting hands-free operation of the motor 40. Although the particular embodiment described herein pertains to the mount 2 attached to a transom, the mount 2 can be attached to the gunwale of a boat or to any other substantially vertical structure along the periphery of a boat. Moreover, the type of trolling motor that may be used with the mount 2 is not limited to electric propulsion but may include motors powered by other means such as hydrocarbons.

The following motor 40 comprises a conventionally-known electric motor and is described by way of example only, and is not to be construed as limiting. The motor 40 generally consists of a shaft 42 having a control unit 48 located above water at one end, and a submerged drive unit 46 located at the other end. The submerged drive unit 46 has an electric motor (not shown) that rotates a propeller 62 providing thrust for the boat 66, and a skeg 64 providing directional stability for the motor 40 as it moves through the water. The shaft 42 is slidably received within a height adjustment collar 45 and frame pipe 54. The depth of the drive unit 46 below the water surface is determined by the position of the height adjustment collar 45 along the shaft 42. When the drive unit 46 is at the desired depth, the set screw 61 is tightened and the lower surface of the height adjustment collar 45 rests on the upper surface of the frame pipe 54. A power cable 58 is connected to both a power source (not shown), such as a deep cycle direct current marine battery, and the power cable 58 connected to the foot pedal, providing electric current to the control unit 48 and drive unit 46. The control unit 48 and drive unit 46 are operably connected thereby causing the orientation of the drive unit 46 to mirror the orientation of the control unit 48. A tiller 56 is attached to, and mechanically communicates with, the control unit 48 permitting an operator to change the direction and amount of thrust generated by the drive unit 46 and propeller 62. Rotation of the shaft 42 can be prevented by securing the tension screw 60 in the frame pipe 54 thereby causing the orientation of the control unit 48, shaft 42, and drive unit 46 to be fixed. The motor mount 50 is releasably secured to the transom block 3 of the mount 2 by screw-type clamps 52.

Figure 2:
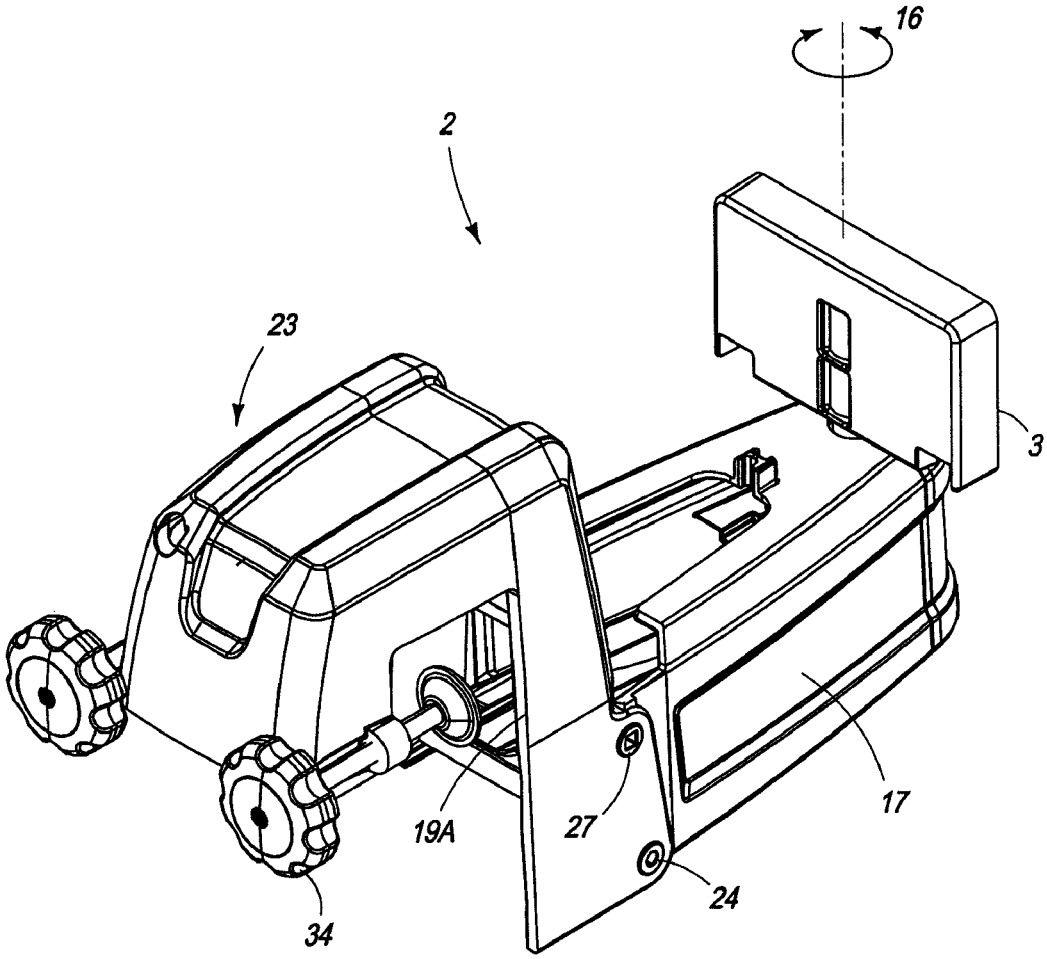
FIG. 2 is a perspective view of a preferred embodiment of a steering mount.
Figure 3:
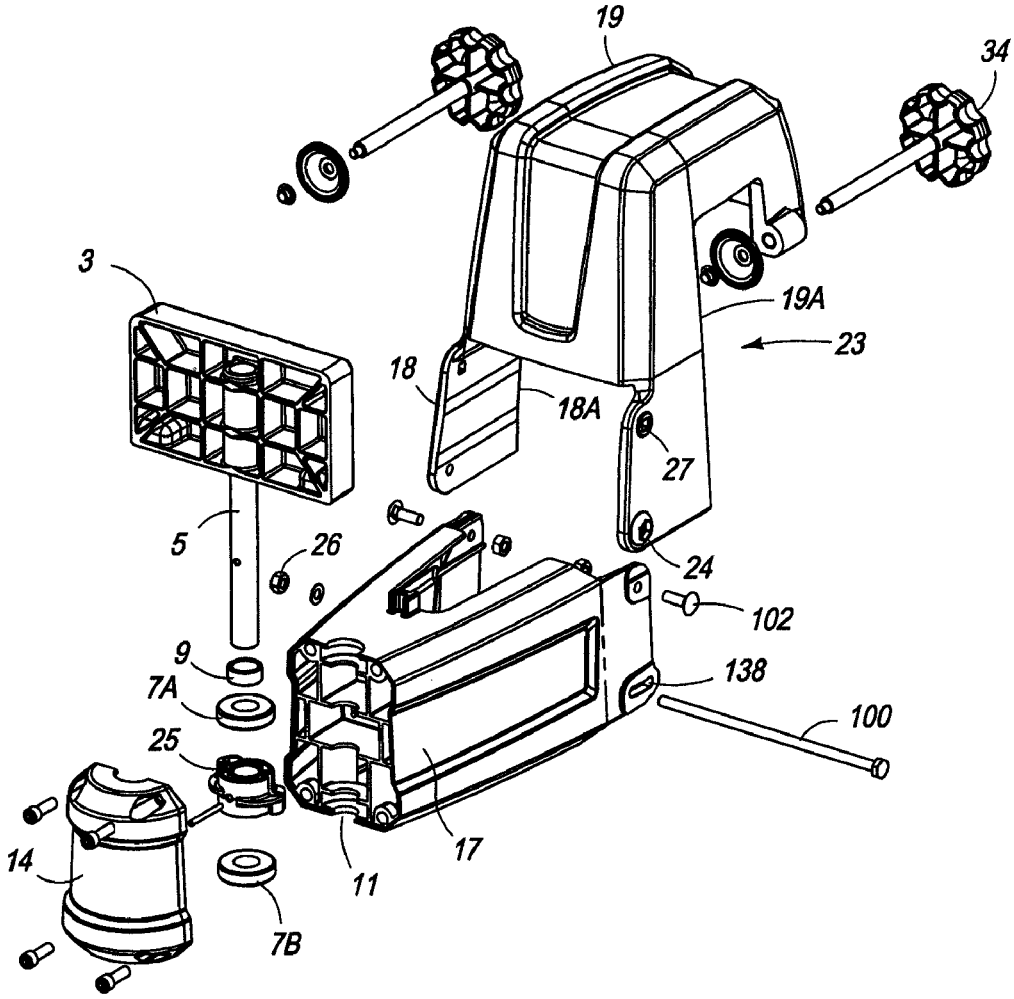
FIG. 3 is an exploded perspective view of a preferred embodiment of a steering mount showing the transom block and drive collar assembly detached from the arm members.
Figure 5:
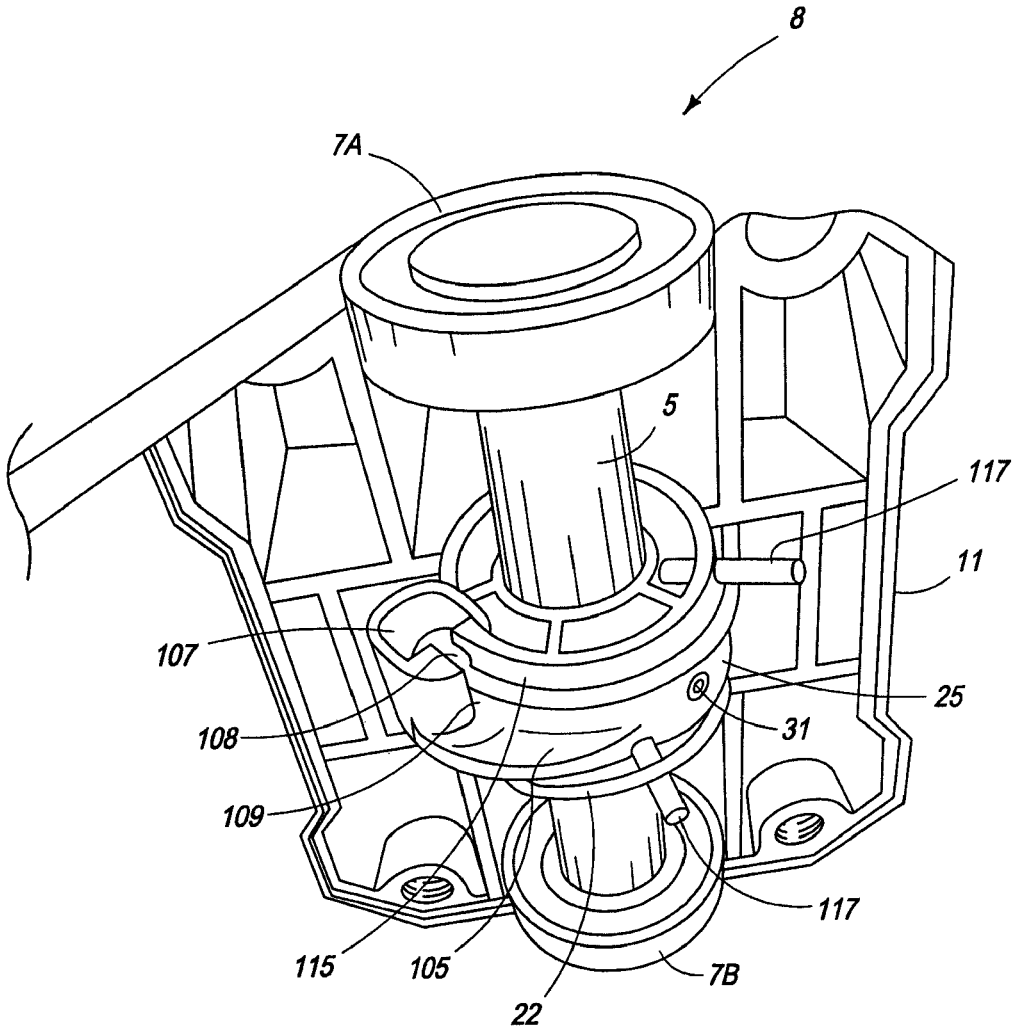
FIG. 5 is a perspective view of a preferred embodiment of the drive collar assembly in position in the proximal end of the arm member.

Referring to FIG. 2, the mount 2 consists of a laterally-spanning elongated transom block 3 that rotates on a shaft about an axis 16. The transom block 3 consists of material having a width preferably between one and two inches, length of six inches, and a height of approximately three and one-half inches thereby providing a mounting support structure for the hand-controlled trolling motor 40. Referring to FIGS. 2 and 3, the block 3 is connected to a shaft 5 that rotates within a housing 11. The housing 11 is disposed at the proximal end of two conjoined arm members 17 and, in conjunction with the end cap 14 secures the shaft 5, bearings 7A, 7B and drive collar 25 in segregated compartments 12A, 12B and 12C. A bushing 9 is preferably positioned immediately atop the upper bearing 7A and immediately below the transom block 3. The conjoined arm members 17 are rotatably connected, preferably with a rod element 100, or other comparable means, to a bracket assembly 23 at a lower rotatable connection 24. The rod element 100 extends through the first overlapping flap member 18, then a first arm of the arm member 17 through the open interior space of the conjoined arm members 17 through the second arm member 17 and finally through the second overlapping flap member 18. A rotatable connection 24 is accomplished through the use of slots 138 disposed within the lower portion of both arm members 17 at their proximal ends. The lower pivot connection 24 allows the conjoined arm members 17 to rotate about the bracket assembly 23 at connection point 27 to accommodate movement of the arms 17 through about a twenty degree arc to accommodate transoms of varying inclination. When the arms 17 are adjusted to a position generally parallel to the water surface, a releasable fastener 26 such as a lock nut may be secured to the end of the rod element 100 fixing the position of the arms 17 and drive assembly 11. FIG. 5 depicts the drive collar assembly 8 in position in the housing 11 without the end cap 14 in position.

Figure 4:
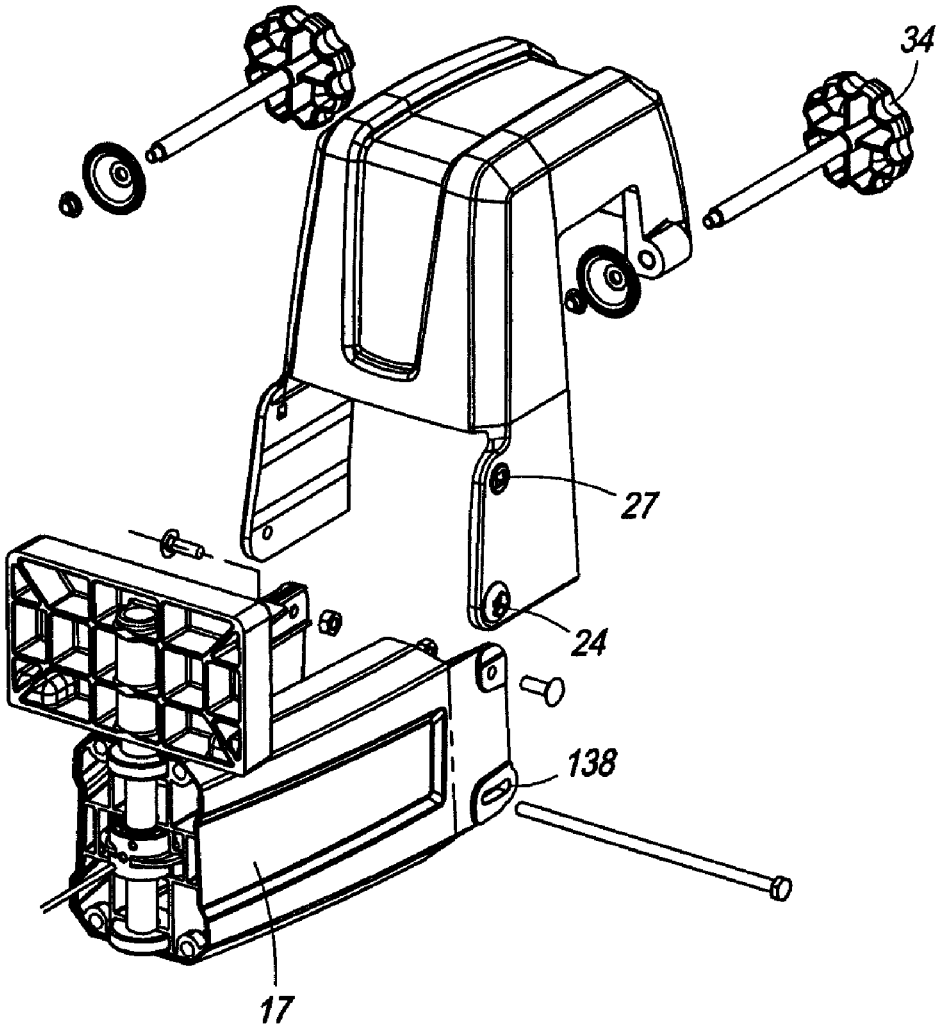
FIG. 4 is an exploded perspective view of a preferred embodiment of a steering mount showing the transom block and drive collar assembly in place on the arm member.

FIGS. 3 and 4 depict that the arm members 17 are secured to the bracket assembly 23 at connection point 27 by standard securement means such as rivets, bolts 102 or other attachment means familiar to those skilled in the art. The bracket assembly 23 consists of two downwardly extending flap members 18, a C-shaped overhang member 19 and releasable fasteners 34, such as screw clamps, that serve to secure the bracket assembly 23 to the transom 68. The flap members 18, as discussed above, overhang the rearmost portions of the arm members 17 and cooperate, in a pivotal fashion, with the aim members 17 to accommodate transoms of various angles. The back sides 18A of the flap members 18 and the backsides 19A of the overhang member 19 follow the contour of the outboard side of the transom 68. The C-shaped overhang member 19 is in contact with the outboard side and top of the transom 68. The inboard portion of the C-shaped overhang member has screw-type clamps 34 for releasably securing the mount 2 to the transom 68. The arms 17 and bracket assembly 23 are manufactured from a rigid material, for example, composite material, plastic or metal.

Referring to FIG. 5, the drive collar housing 11 supports the drive collar assembly 8 which consists of an elongated shaft 5 installed within the inner race of sealed ball bearings 7A, B and the drive collar 25. The shaft 5 is preferably manufactured from a rigid material, for example, composite material, carbon fiber, or metal. The drive collar 25 is manufactured from a rigid material, including, but not limited to, composite material or metal. The drive collar 25 is mounted on the shaft 5 and fixedly secured thereto by tightening a spring pin 31 located on the drive collar 25. The drive collar 25 utilizes separator flanges 105 on opposite sides of the drive collar to separate the upper flexible cable 21 from the lower flexible cable 22. In addition, the drive collar utilizes retaining pockets 107 for securing the first ball fittings 108 fixedly secured to the ends of the upper and lower flexible cables 21, 22. The ball fittings 108 of the cables 21, 22 are positioned into the retaining pockets 107 with the cable extending outwardly through an opening 109. The upper retaining pocket 107 is positioned so that the upper cable 21 is in contact with the drive collar 25 outer rotational surface 115 for approximately 180 degrees when the transom block 3 is in the central position. When the upper cable 21 is placed under tension from actions at the foot pedal 70, the transom block can rotate the maximum range of approximately 90 degrees from its neutral center position. Likewise, the lower retaining pocket 107 is positioned so that the lower cable 22 is in contact with the drive collar outer rotational surface 115 for approximately 180 degrees when the transom block 3 is in the central position. When the lower cable 22 is placed under tension from actions at the foot pedal 70, the transom block will rotate the maximum range or a full 90 degrees from center position but opposite in direction from when the upper cable 21 is under tension.

Figure 6:
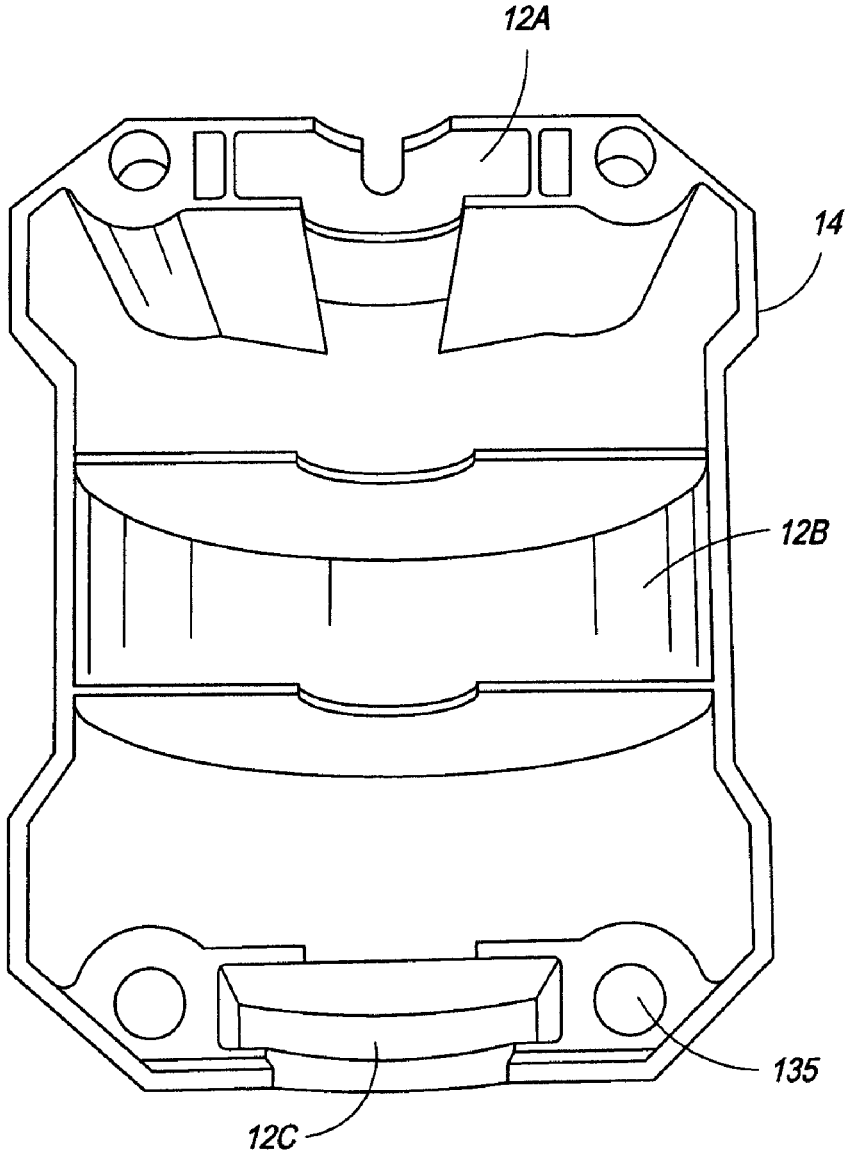
FIG. 6 is a plan view of a preferred embodiment of an end cap.

Still referring to FIG. 5, and extending perpendicularly outwardly from the outer rotational surface 115 of the drive collar 25 are two posts 117. The posts 117, located adjacent the upper and lower cables 21, 22 serve to retain the cables in position and prevent them from lodging between the drive collar 25 and the housing 11 and causing the cables 21, 22 to jam the rotating assembly 8. FIG. 3 depicts the placement of the end cap 14 and its relation to the drive collar housing 11 of the conjoined arm plates 17. The end cap 14 interior structural features as seen at FIG. 6, mirror the structure of the drive collar housing 11 and provide open areas for placement of the bearings 7A, B and the drive collar 25. Specifically, the end cap 14 structure includes compartments 12A, 12B and 12C to house the drive assembly 8 components. The first compartment 12A houses the upper bearing 7A, while the third compartment 12C houses the lower bearing 7B. The center compartment 12B houses the drive collar 25. The end cap 14 is preferably secured to the drive collar housing 11 with standard screws placed through the end cap 14 holes 135.

Figure 7:
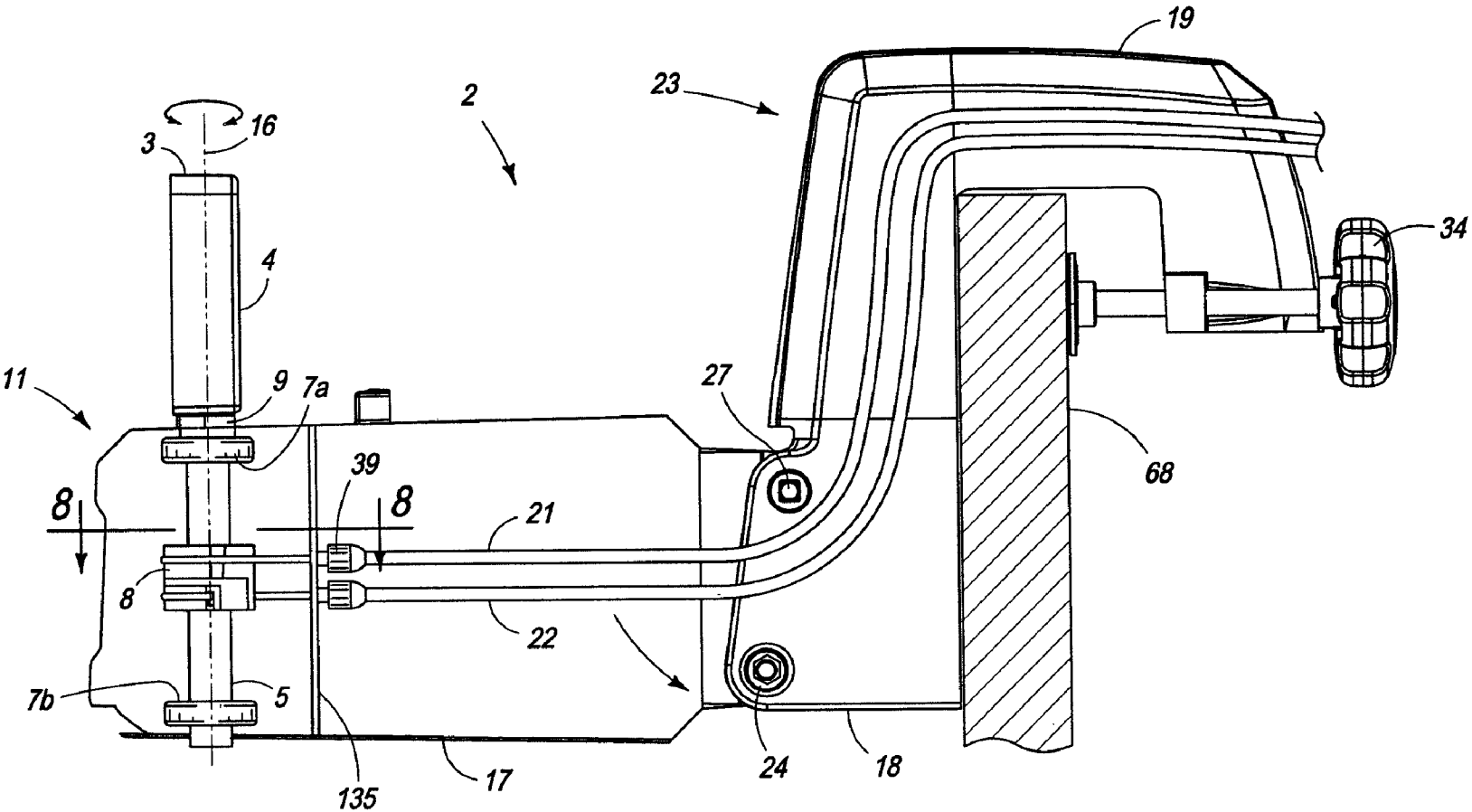
FIG. 7 is an elevation view of a preferred embodiment of a steering motor mount attached to the transom of a boat.

FIG. 7 provides an elevation view of the interior of the trolling motor mount 2 in position on a transom 68. The trolling motor mount 2 is secured in position by the clamps 34 tightened against the transom 68. This view details the upper and lower cables 21, 22 transiting from the foot pedal 70 through the C-shaped overhang member 19, between the flap members 18, into the interior of the arm members 17 and feeding into threaded cable adjusters 39 that secure the cables into a molded flange 135 that restrains the cable housing in an upper and lower position. The upper and lower cables 21, 22 emerge from their respective cable housing and as previously detailed extend around the outer rotational surface 115 of the drive collar 25 with the ball fittings 108 secured in the respective upper and lower retaining pockets 107.

Figure 8:
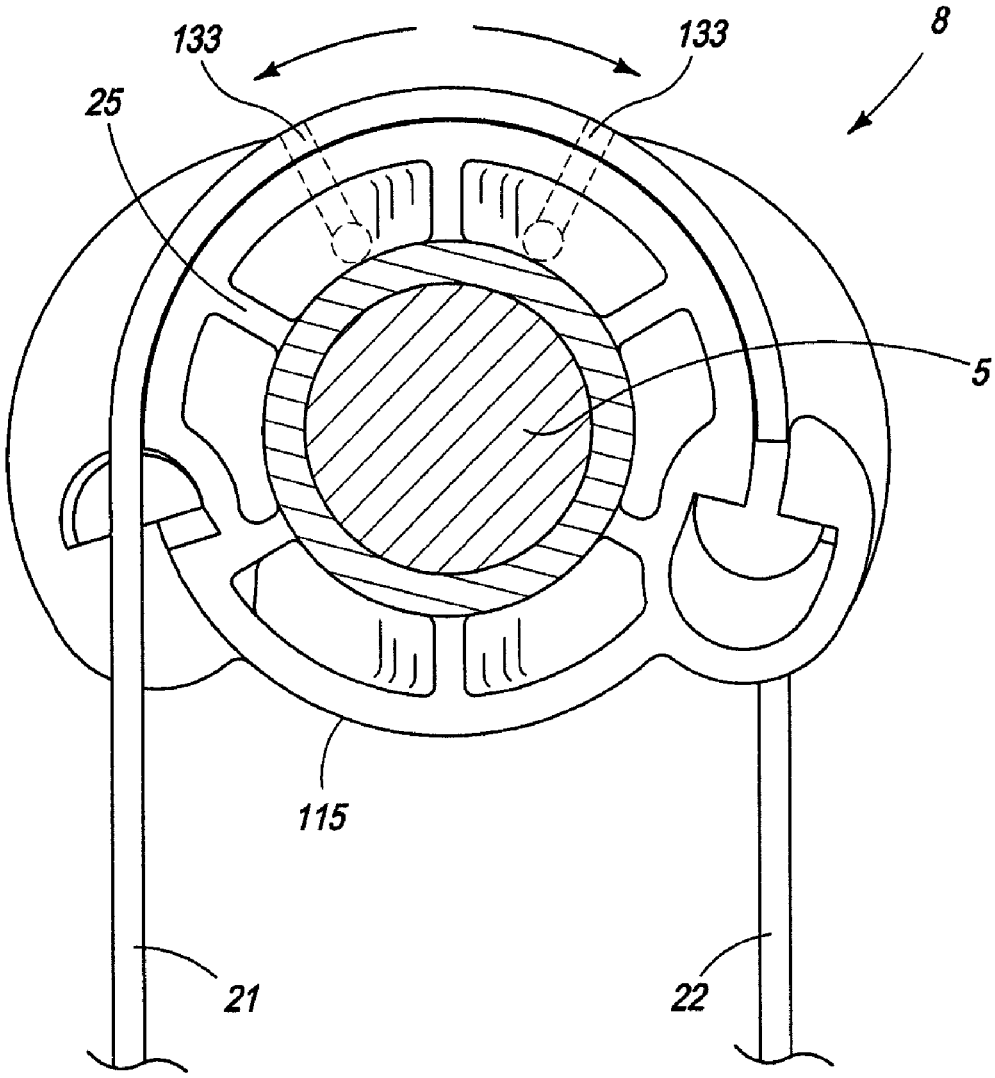
FIG. 8 is top plan view of a preferred embodiment of a drive collar of a drive assembly of a steering motor mount.

FIG. 8 is a cross sectional view of FIG. 7 revealing the structure of the drive collar assembly 8 from just above the drive collar 25 in a top down plan view. This view depicts the ball fittings 108 of the cables 21, 22 within their respective upper and lower retaining pockets 107. FIG. 8 also conveys the 180 degree wrap of the cables 21, 22 around the outer rotational surface 115 of the drive collar 25, when in the center position, to facilitate achieving a full 90 degrees of rotation from center when the respective cables are placed under tension by operation of the foot pedal 70. This figure also reveals the slots 133 for the posts 117 that serve to keep the cables 21, 22 from being wedged between the drive collar 25 and the housing 11 and thereby jamming, and rendering inoperable, the motor mount 2.

Figure 9:
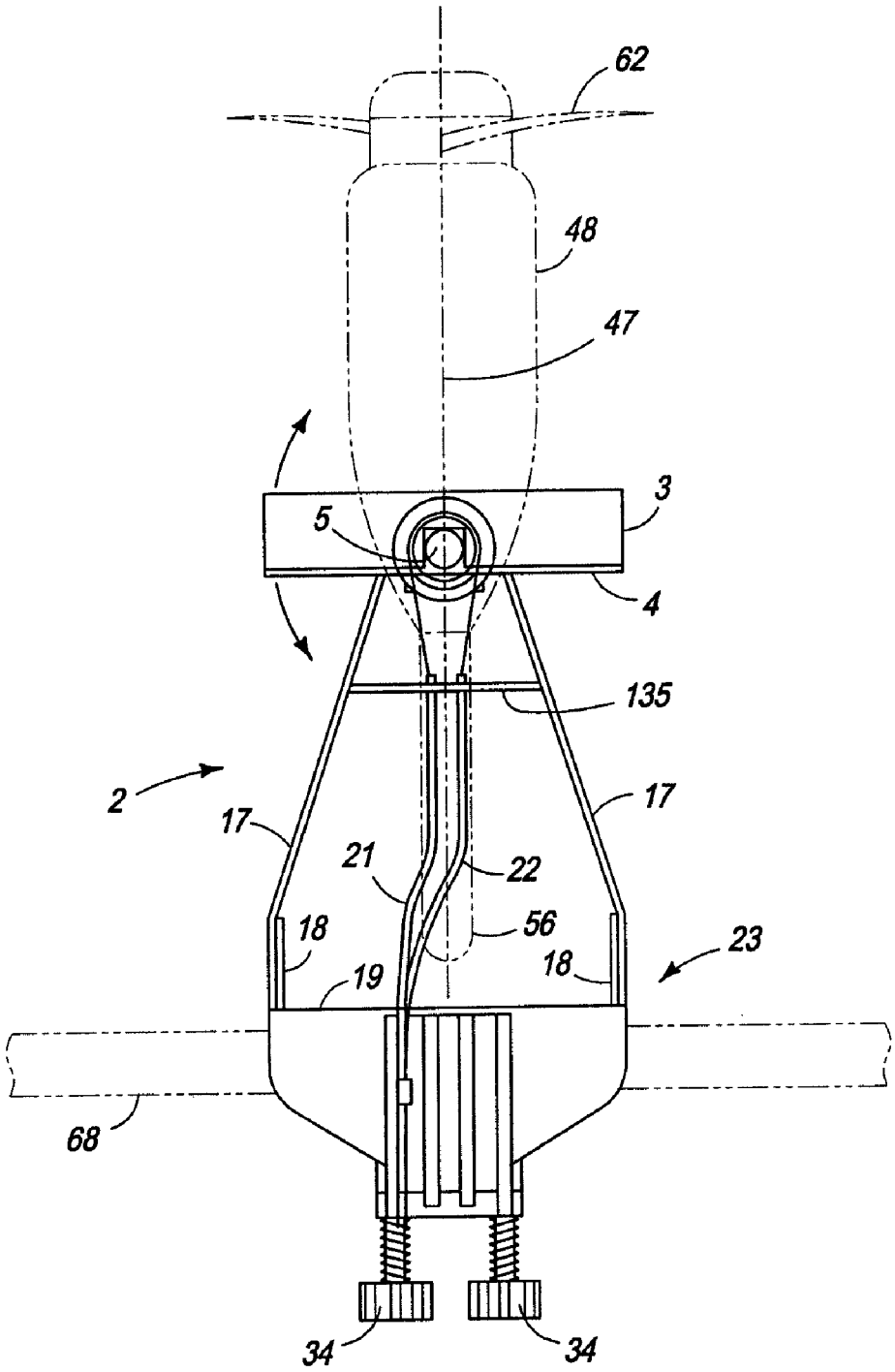
FIG. 9 is a top view of a preferred embodiment of a steering mount attached to the transom of a boat showing a trolling motor oriented perpendicular to the rear of a boat.
Figure 10:
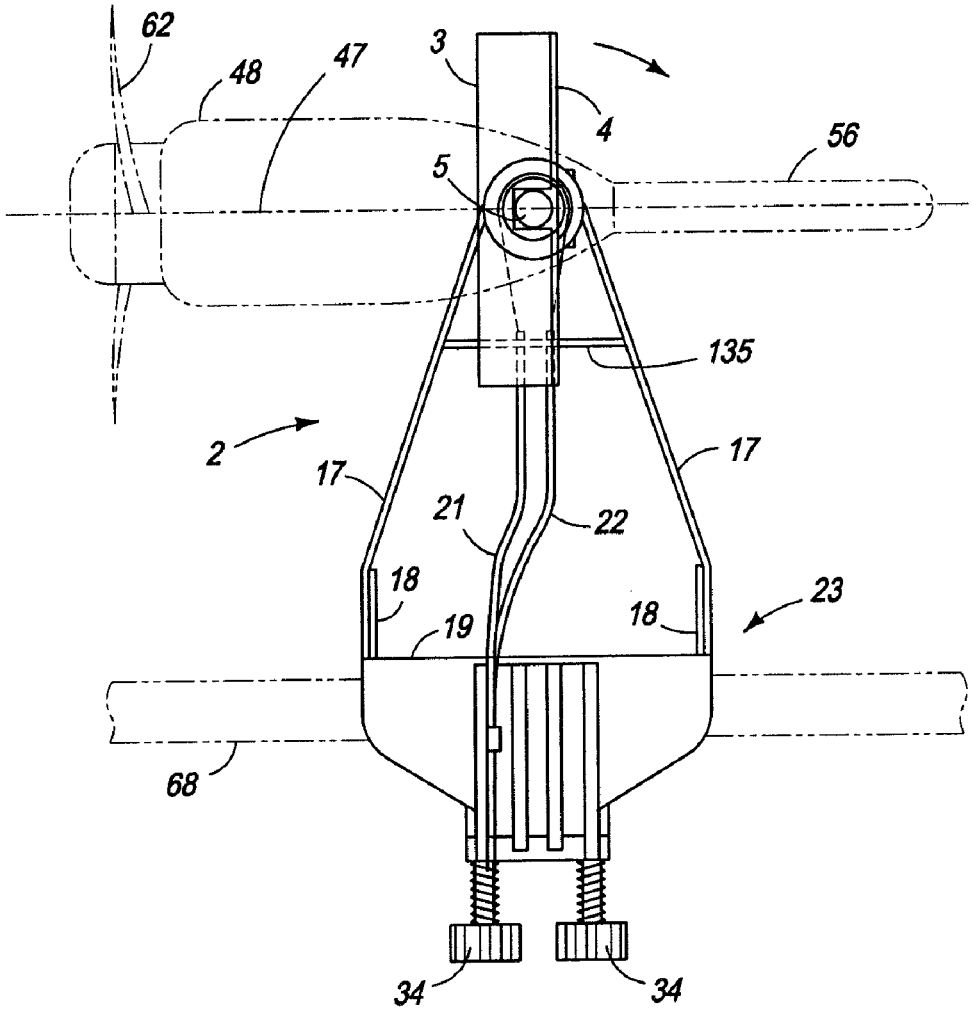
FIG. 10 is a top view of a preferred embodiment of a steering mount attached to the transom of a boat showing a trolling motor oriented to the right side of the boat.
Figure 11:
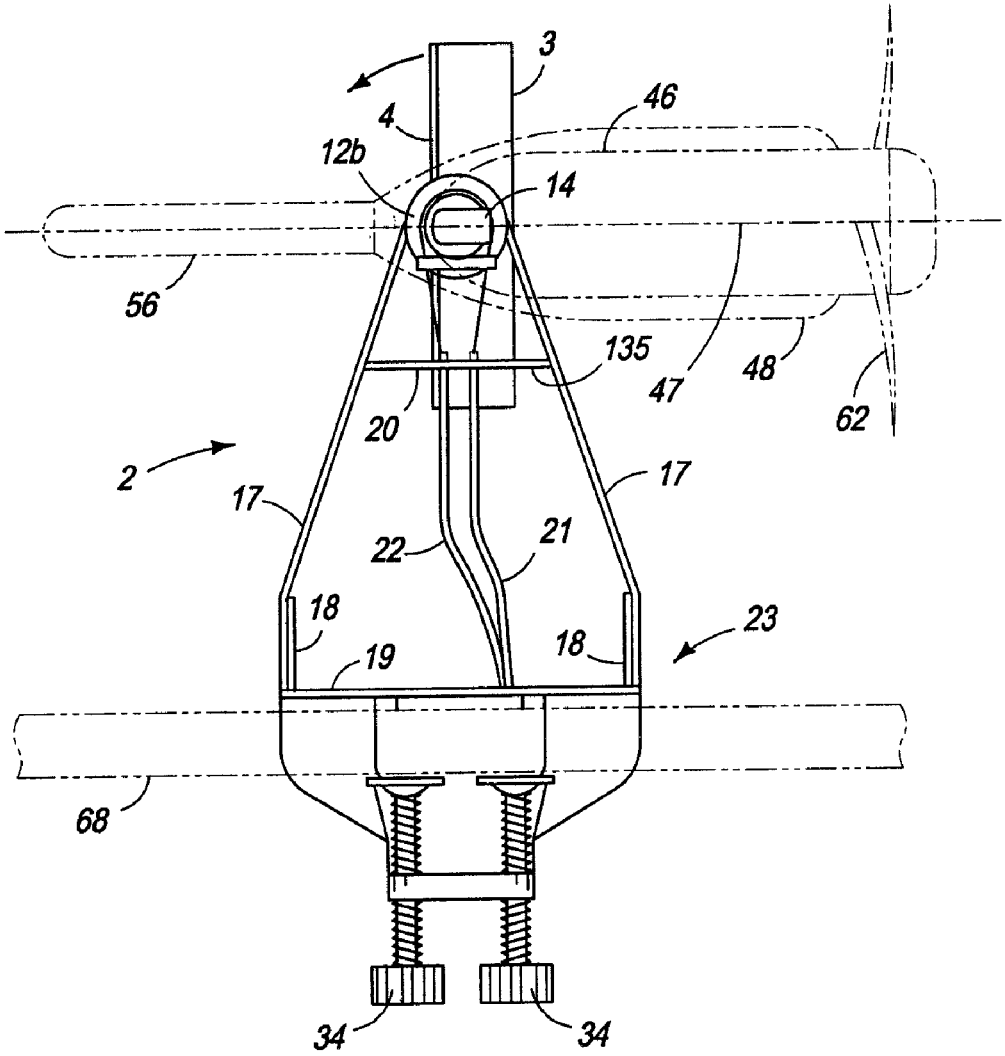
FIG. 11 is a top view of a preferred embodiment of a steering mount attached to the transom of a boat showing a trolling motor oriented to the left side of the boat.

FIG. 9 is a plan view of the trolling motor mount 2 secured to a transom 68 with the transom block 3 shown in a centrally disposed position. In this configuration each of the cables 21, 22 wrap around the outer rotational surface 115 of the drive collar 25 roughly 180 degrees. FIG. 10 is a plan view of the transom block shown rotated 90 degrees to the left of center. In this orientation, the upper cable 21 wraps roughly 90 degrees of the outer rotational surface 115 of the drive collar 25 while the lower cable 22 wraps around roughly 270 degrees of the outer rotational surface of the drive collar 25. The trolling motor mount 2 will preferably utilize a hard stop (not shown) atop the conjoined arm members 17 to prevent any rotation of transom block 3 beyond 90 degrees from center. FIG. 11 is a plan view of the transom block shown rotated 90 degrees to the right of center. In this orientation, the upper cable 21 wraps roughly 270 degrees of the outer rotational surface 115 of the drive collar 25 while the lower cable 22 wraps roughly 90 degrees of the outer rotational surface of the drive collar 25. As previously noted, the trolling motor mount 2 will preferably utilize a hard stop (not shown) atop the conjoined arm plates to prevent any rotation of transom block 3 beyond 90 degrees from center.

Figure 12:
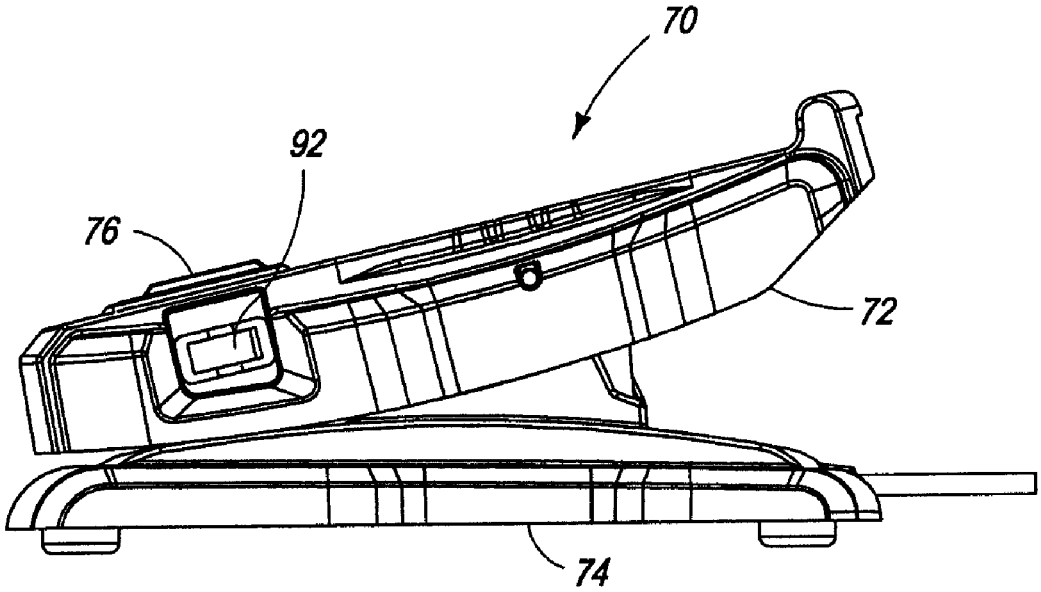
FIG. 12 is a side elevation view of a preferred embodiment of a foot pedal.

FIG. 12 is an elevation view of the foot pedal 70 utilized to change the orientation of the transom block 3 and the trolling motor 40 secured thereto. As mentioned above, rotation of the transom block 3 is controlled by a foot pedal 70 located within the boat 66. Referring to FIGS. 13 and 14A-C, the foot pedal 70 generally consists of a base 74 supporting a pedal 72 pivotally connected to sidewalls 90 by a pivot shaft 78. A pair of vertically spaced arms 86 depend from the pedal 72 having a linkage pin 88 at a distal end adapted for receiving the ends of the upper and lower cables 21, 22 which are connected to the drive collar assembly 8 at their opposite ends. The housings of the upper cable 21 and lower cable 22 are secured within blocks 80, 82 respectively, thereby permitting the cables 21, 22 to be drawn in and out of their protective housings. A power cable 84 is connected to both the power cable 58 and the power source (not shown) at one end, and to a momentary switch 76 and an on-off switch 92 on the pedal 72 at the other end. The operator can turn the power on and off to the foot pedal 72 by toggling the on-off switch 92, and turn the power on and off to the motor with the momentary switch 76 by movement of their foot.

III. Installation and Operation of Preferred Embodiment Motor Mount 2.

The motor mount 2 is installed on the transom 68 of a boat 66 by positioning the transom block 3 on the outboard side of the boat 66, and sliding the bracket 23 over the transom 68 until the bracket 23 rests upon the top of the transom 68. The mount 2 is releasably secured to the transom 68 by tightening the screw-type clamps 34. Depending upon the angle of the transom 68, the arms 17 can be adjusted to orientate the shaft 5 into a position whereby the rotational axis 16 is generally perpendicular to the surface of the water. Adjustment is made by loosening the fastener 26 at each arm 17 and pivoting the arms 17 up toward the gunwale until the rotational axis 16 is generally perpendicular to the water surface. Then the fastener 26 on each arm 17 is tightened and the mount 2 is ready to receive a trolling motor 40 on the transom block 3.

After attaching the motor 40 to the mount 2 and securing it by tightening the screw-type clamps 52, the shaft 42 is positioned parallel to the outboard surface of the transom block 3. The depth of the drive unit 46 is adjusted by loosening the tension screw 60 in the frame pipe 54, and the set screw 61 in the height adjustment collar 45, and moving the motor 40 vertically within the frame pipe 54. When the drive unit 46 is at the desired depth, the height adjustment collar 45 is positioned to rest against the frame pipe 54 and the set screw 61 is tightened. With the transom block 3 in a neutral position (i.e. parallel with the transom 68) the orientation of the motor 40 is adjusted until the longitudinal axis 47 of the drive unit 46 is perpendicular to the outboard face of the transom block 3. This is accomplished by loosening the tension screw 60 on the collar 54 and rotating the shaft 42 of the motor 40 by manual movement of the tiller 56. When the drive unit 46 is at the desired orientation, the tension screw 60 is tightened thereby fixing the orientation of the motor 40 relative to the transom block 3. Since the orientation of the motor 40 is fixed relative to the transom block 3, orientation of the motor 40 is thereafter controlled by the rotation of the transom block 3.

Figure 13:
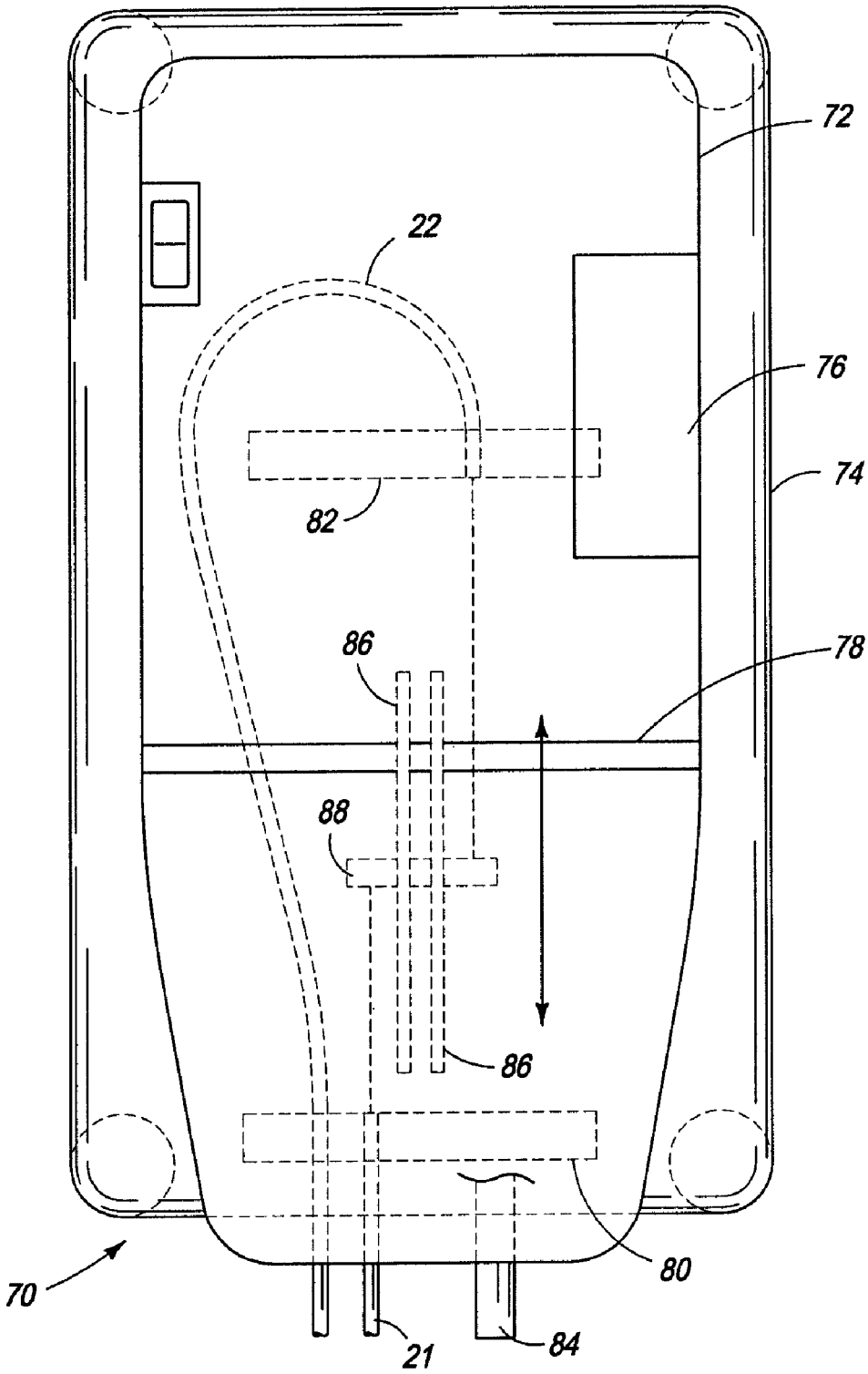
FIG. 13 is a top view of a preferred embodiment of a foot pedal.

As mentioned above, rotation of the transom block 3 is controlled by a foot pedal 70 located within the boat 66. Referring to FIGS. 12-14, the foot pedal 70 generally consists of a base 74 supporting a pedal 72 pivotally connected to sidewalls 90 by a metal pivot shaft 78. A pair of vertically spaced arms 86 depend from the pedal 72 having a linkage pin 88 at a distal end adapted for receiving the ends of the upper and lower cables 21, 22 which are connected to the drive collar assembly 8 at their opposite ends. The housings of the upper cable 21 and lower cable 22 are secured within blocks 80, 82 respectively, thereby permitting the cables 21, 22 to be drawn in and out of the housing. A power cable 84 is connected to both the power cable 58 and the power source (not shown) at one end, and to an on-off switch 76 on the pedal 72. The operator can turn the power on and off to the foot pedal 72 by toggling the on-off switch 76 by movement of their foot.

Figure 14A:
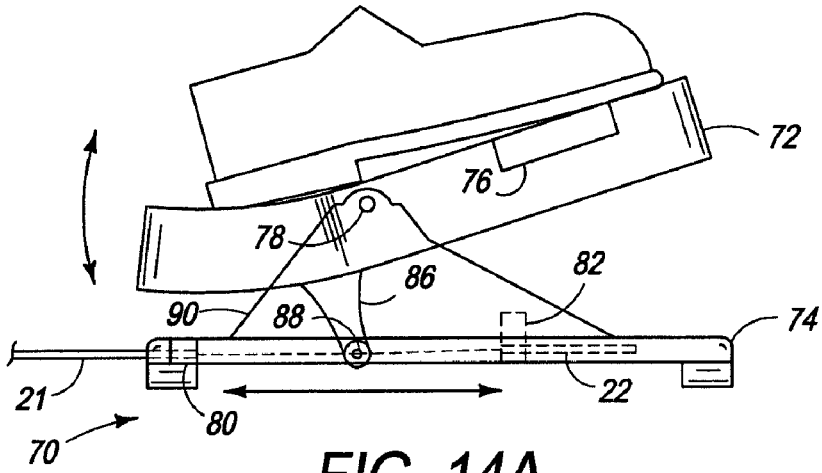
FIG. 14A is a right elevational view of the foot pedal showing the pedal at maximum dorsiflexion.
Figure 14B:
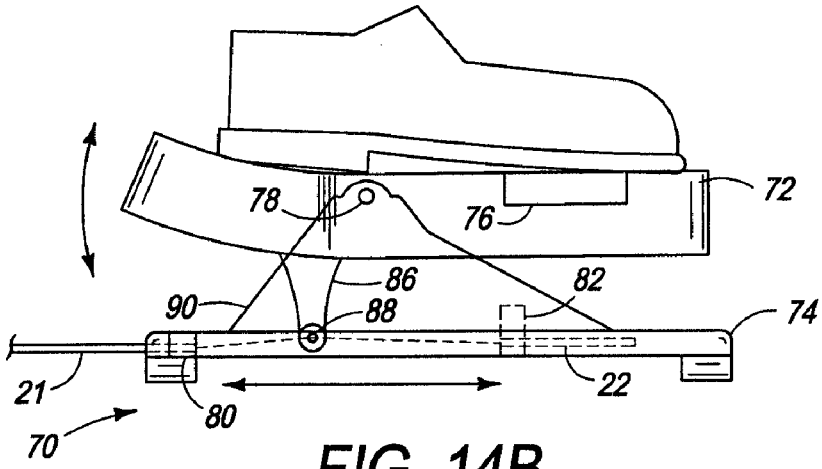
FIG. 14B is a right elevational view of the foot pedal showing the pedal at neutral position.
Figure 14C:
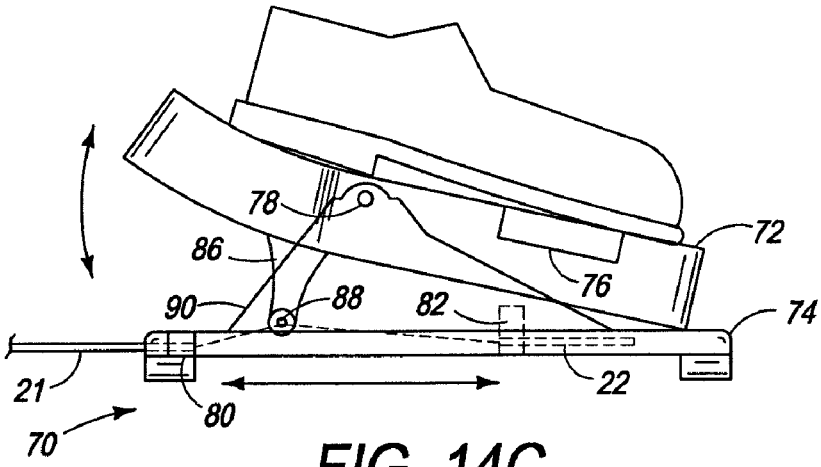
FIG. 14C is a right elevational view of the foot pedal showing the pedal at maximum plantar flexion.

Hands-free control of the orientation of the motor 40 is accomplished by rotating the pedal 72 about the pivot shaft 78. Referring to FIG. 14B, the foot pedal 70 is shown with the pedal 72 in a neutral position, whereby the transom block 3, and attached motor 40 are in a neutral position. Referring to FIG. 14A, the foot pedal 70 is shown with the pedal 72 fully rotated in an upward (dorsiflexion) manner. Dorsiflexion pulls the upper control cable 21 from the left or back of the foot pedal 70 to the right or front of the pedal 70, thereby pulling the upper control cable 21 inboard at the drive collar assembly 8 causing the transom block 3 and drive unit 46 to rotate counter-clockwise (FIGS. 9-11) changing the direction of thrust generated by the propeller 62. Referring to FIG. 14 C, the foot pedal 70 is shown with the pedal 72 fully rotated in a downward (plantar flexion) manner. Plantar flexion pulls the lower control cable 22 from the right or front of the foot pedal 70 to the left or back of the foot pedal 70, thereby pulling the lower control cable 22 inboard at the drive collar assembly 8 causing the transom block 3 and drive unit 46 to rotate clockwise and changing the direction of thrust generated by the propeller 62.

Although particular aspects of the mount 2 have been described in conjunction with an exemplar embodiment, it is evident that other embodiments and variations of the mount 2 may be appreciated by those skilled in the art from a consideration of the specification and particular embodiments disclosed herein. Moreover, it is to be understood that the mount 2 and its constituent elements can be manufactured or fabricated from a wide range of suitable materials, and in various sizes using assorted manufacturing and fabrication techniques.

I claim:

1. A steering mount for use with a watercraft trolling motor comprising:

a bracket assembly for securing the steering mount to a substantially vertical surface of a watercraft;

an arm member secured to the bracket assembly;

a drive assembly secured to the arm member;

a transom block attached to the drive assembly for releaseably securing the trolling motor;

a first and second drive cable with a first end of the first and second drive cables secured within the drive assembly for rotating the transom block;

a control unit attached to a second end of the first and second drive cables for imparting rotational movement to the transom block; and an electrical switch disposed within the control unit tor energizing and de-energizing the trolling motor.

2. The steering mount of claim 1, wherein the bracket assembly is comprised of securing means for releasably securing the mounting bracket to the watercraft.

3. The steering mount of claim 2, wherein the securing means is comprised of at least one threaded element.

4. The steering mount of claim 2, wherein the securing means is comprised of at least one spring loaded element.

5. The steering mount of claim 1, wherein the arm member has a distal and a proximal end, the distal end of the arm member being pivotally secured to the bracket assembly.

6. The steering mount of claim 1, wherein the proximal end of the arm member is secured to the drive assembly.

7. The steering mount of claim 1, wherein the drive assembly further comprises, a drive collar and an upper and lower bearing assembly, the upper and lower bearing assembly are oppositely disposed from one another by the drive collar, a shaft with a first and second end passing through centrally disposed opening in the drive collar and an inner race of the upper and lower bearings, the drive collar being fixedly secured to the shaft.

8. The steering mount of claim 7, wherein the first ends of the first and second drive cable are secured within the drive assembly for rotating the transom block.

9. The steering mount of claim 1, wherein the control unit is comprised of a base and a pedal with the pedal being supported by the base with a pair of sidewalls pivotally connected to the pedal allowing rotation of the pedal about the base.

10. The steering mount of claim 9, wherein an arm extends downwardly from the pedal engaging the first and second drive cable and imparting translation to the second ends of the first and second drive cables as the pedal pivots about the base.

11. The steering mount of claim 9, wherein the pedal further comprises an on-off switch that is in operable communication with the trolling motor.

12. The steering mount of claim 9, wherein the pedal further comprises a momentary switch that is in operable communication with the trolling motor.

13. A steering mount for use with a watercraft trolling motor comprising:

a bracket assembly for securing the steering mount to a substantially vertical surface of a watercraft;

an arm member pivotally secured to the bracket assembly;

a drive assembly secured to the arm member;

a transom block attached to the drive assembly to which the trolling motor can be releasably secured;

a first and second drive cable for rotating the transom block;

a foot pedal attached to the first and second drive cable for selectively imparting tension upon either the first or second cable to thereby rotate the transom block; and a first and second electrical switch disposed within the foot pedal for engaging the trolling motor.

14. The steering mount of claim 13, wherein the bracket assembly is comprised of means for releasably securing the bracket assembly to the watercraft.

15. The steering mount of claim 14, wherein the arm member comprises a proximal and a distal end, the distal end of the arm member being pivotally connected to the bracket assembly.

16. The steering mount of claim 15, wherein the drive assembly is secured to the proximal end of the arm member, the drive assembly comprising a drive collar and an upper and lower bearing assembly oppositely disposed from one another by the drive collar and a shaft with a first and second end passing through centrally disposed openings in the drive collar and an inner race of the upper and lower bearings, the drive collar being fixedly secured to the shaft.

17. The steering mount of claim 16, wherein a transom block is secured to the first end of the shaft.

18. The steering mount of claim 13 wherein a first end of the first and second drive cable are secured within the drive assembly for rotating the transom block.

19. The steering mount of claim 13, wherein the control unit is in operable communication with the drive assembly for directional control through the first and second drive cables.

20. The steering mount of claim 13, wherein the control unit is in operable communication with the trolling motor for controlling thrust production.

21. A steering mount for use with a watercraft trolling motor comprising:

a bracket assembly for securing the steering mount to a substantially vertical surface of a watercraft;

an arm member secured to the bracket assembly;

a drive assembly secured to the arm member, the drive assembly including a shaft with a drive collar fixedly secured to the shaft and a transom block secured to a first end of the shaft, the transom block for releasably securing the trolling motor, the drive collar including at least two retaining pockets for securing a first end of a first and second drive cable, the first and second drive cables being separated on the drive collar by at least one separator flange, a control unit attached to a second end of the first and second drive cables for imparting rotational movement to the drive assembly; and an electrical switch disposed within the control unit for energizing and de-energizing the trolling motor.

22. The steering mount of claim 21, wherein the first and second ends of the first and second drive cables include ball fittings.

23. The steering mount of claim 22, wherein the ball fittings are secured within the retaining pockets of the drive collar.

24. The steering mount of claim 21, wherein the drive collar retaining posts are secured to the drive collar for limiting lateral movement of the first and second drive cables.

25. The steering mount of claim 21, wherein the shaft rotates within the races of at least two bearings that are disposed opposite the drive collar.

26. The steering mount of claim 21, wherein the arm member further comprises a proximal and a distal end, the distal end of the arm member pivotally connected to the bracket assembly and the proximal end of the arm member comprising a drive collar housing.

27. The steering mount of claim 26, wherein the drive assembly is positioned within the drive collar housing.

28. The steering mount of claim 27, wherein the drive assembly is secured in position in the drive collar housing with an end cap.

* * * * *